US009711951B2

(12) United States Patent
Iwasaki et al.

(10) Patent No.: US 9,711,951 B2
(45) Date of Patent: Jul. 18, 2017

(54) SPARK PLUG

(71) Applicant: NGK SPARK PLUG CO., LTD., Nagoya-shi, Aichi (JP)

(72) Inventors: Yoshitomo Iwasaki, Nagoya (JP); Haruki Yoshida, Tajimi (JP); Toshitaka Honda, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/071,728

(22) Filed: Mar. 16, 2016

(65) Prior Publication Data

US 2016/0285242 A1 Sep. 29, 2016

(30) Foreign Application Priority Data

Mar. 27, 2015 (JP) ..... 2015-065517

(51) Int. Cl.

| | |
|---|---|
| ***H01T 13/20*** | (2006.01) |
| ***H01T 13/40*** | (2006.01) |
| ***H01T 13/34*** | (2006.01) |
| ***H01T 13/41*** | (2006.01) |
| ***H01T 13/08*** | (2006.01) |
| ***H01T 13/36*** | (2006.01) |

(52) U.S. Cl.

CPC ..... *H01T 13/40* (2013.01); *H01T 13/08* (2013.01); *H01T 13/34* (2013.01); *H01T 13/36* (2013.01); *H01T 13/41* (2013.01)

(58) Field of Classification Search

CPC ..... H01T 13/22; H01T 13/20; H01T 13/39
USPC ..... 313/141, 144, 145
See application file for complete search history.

(56) References Cited

U.S. PATENT DOCUMENTS

| | | | | |
|---|---|---|---|---|
| 8,058,786 | B2 | 11/2011 | Below | 313/143 |
| 2009/0189505 | A1 | 7/2009 | Below | 313/143 |
| 2010/0264823 | A1 | 10/2010 | Suzuki et al. | 315/71 |
| 2016/0204580 | A1 | 7/2016 | Yoshida et al. | H01T 13/39 |

FOREIGN PATENT DOCUMENTS

| | | | | |
|---|---|---|---|---|
| JP | 2009-245716 A | 10/2009 | | H01T 13/20 |
| WO | WO 2015/029749 A1 | 3/2015 | | H01T 13/20 |

OTHER PUBLICATIONS

Extended European Search Report issued in corresponding European Patent Application No. 16158991.6, dated Aug. 22, 2016.
The Home Depot, "M12-Screws-Fastriers," website printout from www.homedepot.com/b/Hardware-Fasteners-Screws/M12/N-5yc1vZc2b0Z1z0sfzx, printout date Apr. 4, 2017.

(Continued)

*Primary Examiner* — Vip Patel
(74) *Attorney, Agent, or Firm* — Kusner & Jaffe

(57) ABSTRACT

A spark plug having a resistor disposed within a through hole of an insulator and between a center electrode and a metal terminal so as to be spaced apart from the center electrode in a direction of an axial line; and a conductive glass seal layer provided between the resistor and the center electrode and electrically connecting the resistor and the center electrode to each other, the conductive glass seal layer has a diameter of 3.9 mm or less, and a joined surface of the conductive glass seal layer and the resistor has a convex shape toward the center electrode side. A length $\alpha$ from a rear end to a front end of the joined surface and a maximum length $\beta$ of the conductive glass seal layer in the direction of the axial line meets a relation of $\alpha/\beta \geq 0.4$.

8 Claims, 5 Drawing Sheets

(56) References Cited

OTHER PUBLICATIONS

The Home Depot, "Everbilt M12-1.75 x 100 mm Zinc-Plated Steel Hex-Head Cap Screw (2 per bag)," website printout from www.homedepot.com/p/Everbilt-M12-1-75-x-100-mm-Zinc-Plated-Steel-Hex-Head-Cap-Screw-2-per-bag-801988/204281899, print-out date Apr. 4, 2017.

◆AIRTIGHTNESS TEST

ADD COMPRESSED AIR TO FIRING END AT ROOM TEMPERATURE FOR 1 MINUTE, MEASURE AMOUNT OF AIR LEAKAGE FROM SCREW PORTION, AND MEASURE COMPRESSION PRESSURE AT WHICH AMOUNT OF AIR LEAKAGE BECOMES EQUAL TO OR LESS THAN 1.5 ml/min

| SAMPLE | SEAL DIAMETER R | SEALING MATERIAL AMOUNT (g) | RISE AMOUNT | SEALING MATERIAL LENGTH | INTER-RESISTOR DISTANCE | SEALING MATERIAL LENGTH RATIO | |
|---|---|---|---|---|---|---|---|
| | | | $\alpha$ | $\beta$ | $\gamma$ | $\alpha/\beta$ | AIRTIGHTNESS EVALUATION |
| 1 | 3.0 | 0.20 | 8.5 | 16.0 | 3.2 | 0.53 | B |
| 2 | 3.9 | 0.30 | 7.5 | 15.0 | 3.4 | 0.50 | A |
| 3 | 3.0 | 0.05 | 3.0 | 7.0 | 1.0 | 0.43 | E |
| 4 | 3.9 | 0.10 | 3.0 | 7.0 | 1.0 | 0.43 | C |
| 5 | 3.0 | 0.15 | 4.6 | 11.0 | 3.0 | 0.42 | B |
| 6 | 3.9 | 0.25 | 4.6 | 11.0 | 3.0 | 0.42 | A |
| 7 | 3.0 | 0.15 | 4.0 | 10.0 | 3.4 | 0.40 | C |
| 8 | 3.9 | 0.25 | 4.0 | 10.0 | 3.4 | 0.40 | B |
| 9 | 3.9 | 0.20 | 4.2 | 10.4 | 3.0 | 0.40 | B |
| 10 | 3.0 | 0.10 | 4.0 | 10.0 | 3.0 | 0.40 | C |
| 11 | 3.0 | 0.10 | 4.2 | 10.4 | 2.4 | 0.40 | E |
| 12 | 3.9 | 0.20 | 3.8 | 9.6 | 2.4 | 0.40 | C |
| 13 | 3.0 | 0.05 | 2.6 | 6.6 | 1.0 | 0.39 | F |
| 14 | 3.9 | 0.10 | 2.6 | 6.6 | 1.0 | 0.39 | E |
| 15 | 3.9 | 0.20 | 3.4 | 9.6 | 2.6 | 0.35 | D |

| COMPRESSION PRESSURE (Mpa) | AMOUNT OF AIR LEAKAGE IS EQUAL TO OR LESS THAN 1.5 ml/min |
|---|---|
| 10 | A |
| 7.5 | B |
| 5 | C |
| 3 | D |
| 2.5 | E |
| 2 | F |

CONTENTS OF AIRTIGHTNESS EVALUATION

FIG. 5

SPARK PLUG

RELATED APPLICATION

This application claims the benefit of Japanese Patent Application No. 2015-065517, filed Mar. 27, 2015, the entire contents of which are incorporated herein by reference

FIELD OF THE INVENTION

The present invention relates to a spark plug using a glass seal.

BACKGROUND OF THE INVENTION

Conventionally, a spark plug including a tubular insulator having a resistor incorporated therein is known (see, for example, Japanese Patent Application Laid-Open (kokai) No. 2009-245716). In such a type of spark plug, a metal terminal is disposed at one end portion side of a through hole of the insulator, and a center electrode is disposed at the other end portion side of the through hole. The resistor is disposed between the metal terminal and the center electrode.

The resistor housed in the through hole of the insulator is formed from a mixture of glass powder and a conductive substance such as carbon black powder or metal powder. The content of metal in the resistor is not so high, and thus, in many cases, it is difficult to directly join the resistor to the metal terminal or the center electrode which are made of metal. Therefore, for example, a conductive glass seal layer containing an amount of metal powder larger than that in the resistor is disposed between the resistor and the metal terminal or between the resistor and the center electrode, thereby enhancing the joining force.

An example of a process for manufacturing such a spark plug including a resistor will be described below.

(1) After the center electrode is placed in the through hole of the insulator, conductive glass powder is packed therein, then raw material powder of a resistor composition is packed therein, conductive glass powder is further packed therein again, and the metal terminal is finally inserted thereinto to create an assembly.

(2) The assembly is brought into a heating furnace and heated to a temperature equal to or higher than the softening point of glass contained in the resistor composition and the conductive glass powder. Thus, the glass contained in the raw material powder of the resistor composition and the conductive glass powder melts.

(3) Thereafter, in a state where the glass melts, the metal terminal is squeezed-in in the axial direction of the metal terminal, and a state of supporting the metal terminal is maintained until the glass becomes solidified, whereby conductive glass seal layers are formed at the front side and the rear side of the resistor. As a result, the metal terminal and the center electrode are joined to the resistor via the respective conductive glass seal layers and also fixed to the insulator.

In the spark plug disclosed in Japanese Patent Application Laid-Open (kokai) No. 2009-245716, even when the diameter of the conductive glass seal layer is equal to or less than 3.3 mm, since a joined surface of each conductive glass seal layer and the resistor is formed as a curved surface, occurrence of separation at the joined surface is suppressed.

Since the joined surface of each conductive glass seal layer and the resistor is formed as a curved surface, the joining strength therebetween can be enhanced. However, even in the case of exposure to a higher combustion pressure than in the conventional art, the airtightness between each conductive glass seal and the insulator is desirably sufficient. If the airtightness between the insulator and the conductive glass seal layer at the center electrode side is lost, a possibility arises that airtightness required for the spark plug cannot be maintained. There is a concern that such a decrease in sealability is likely to occur particularly when the diameter of the spark plug is reduced.

An advantage of the present application is a small-diameter spark plug which includes a resistor that is able to maintain sufficient airtightness.

SUMMARY OF THE INVENTION

The present invention has been made in order to solve at least a part of the above-described problems, and can be embodied in the following forms or application examples.

(1) According to a first embodiment of the present invention, there is provided a spark plug that may include: a tubular metal shell; an insulator held within the metal shell and having a through hole formed therein so as to extend along a direction of an axial line of the metal shell; a center electrode inserted and fixed in a first end portion of the through hole of the insulator; a metal terminal inserted and fixed in a second end portion of the through hole of the insulator; a resistor disposed within the through hole and between the center electrode and the metal terminal so as to be spaced apart from the center electrode in the direction of the axial line; and a conductive glass seal layer provided within the through hole and between the resistor and the center electrode and electrically connecting the resistor and the center electrode to each other. In the spark plug, the conductive glass seal layer may have a diameter of 3.9 mm or less, and a joined surface of the conductive glass seal layer and the resistor may have a convex shape toward the center electrode side. When a represents a length in the direction of the axial line from a rear end to a front end of the joined surface and $\beta$ represents a maximum length of the conductive glass seal layer in the direction of the axial line, a relation of $\alpha/\beta \geq 0.4$ may be satisfied.

In this spark plug, the adhesion between the glass seal layer and the resistor is good, and it becomes easy to ensure sealability between the glass seal layer and the resistor when the spark plug is mounted to a combustion chamber. Thus, airtightness required for the spark plug can be ensured.

(2) In accordance with a second aspect of the present invention, there is provided a spark plug, as described above, wherein a shortest distance $\gamma$ in the direction of the axial line from the joined surface to the center electrode may be equal to or greater than 3 mm. Accordingly, the sealability can be enhanced further.

(3) In accordance with a third aspect of the present invention, there is provided a spark plug, as described above, wherein the maximum length $\beta$ may be equal to or greater than 11 mm. Accordingly, the sealability can be ensured further.

(4) The diameter of the conductive glass seal layer may be equal to or less than 3.0 mm. Accordingly, even in the spark plug whose diameter is reduced, airtightness required for the spark plug can be ensured. As a result, this can contribute to reduction of the diameter of the spark plug.

(5) In accordance with a fourth aspect of the present invention, there is provided a spark plug, as described above, wherein a screw portion may be formed on an outer periphery of the metal shell and may have a diameter of M12 or less. Accordingly, even in the spark plug whose diameter is reduced as described above, airtightness required for the spark plug can be ensured. As a result, this can contribute to reduction of the diameter of the spark plug.

BRIEF DESCRIPTION OF THE DRAWINGS

FIG. 5 is an explanatory diagram showing evaluation results of each sample.

DETAILED DESCRIPTION OF THE PREFERRED EMBODIMENTS

A. Embodiment

A1. Configuration of Spark Plug

Figure 1:
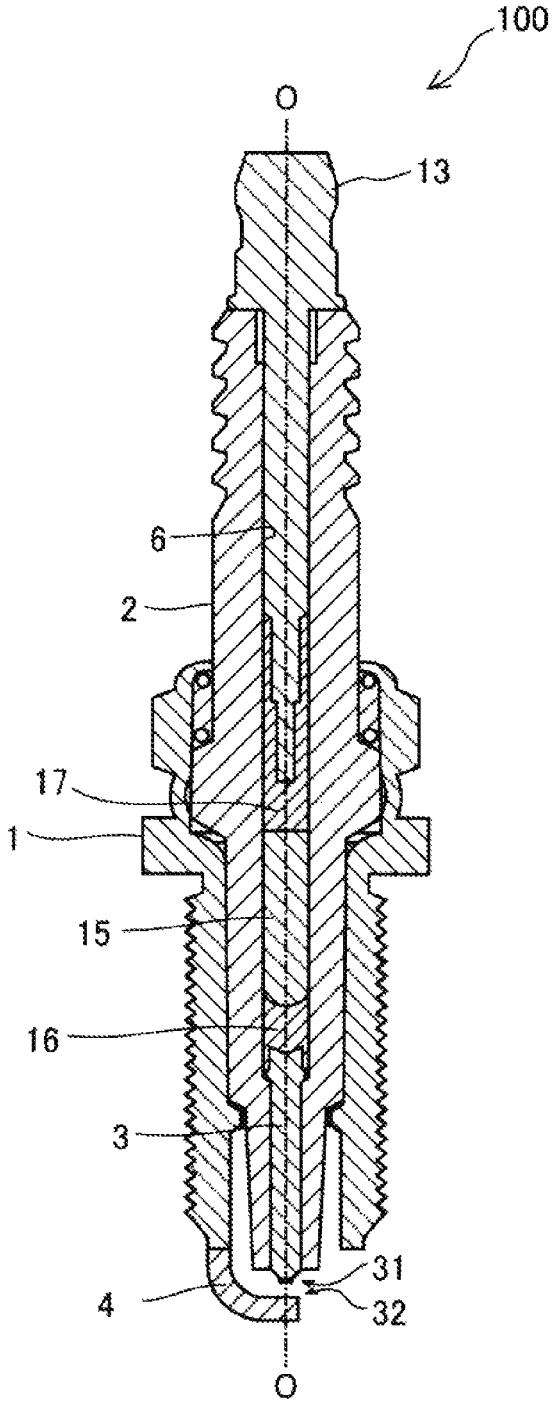
FIG. 1 is a cross-sectional view of a main portion showing the structure of a spark plug according to an embodiment of the present invention.

FIG. 1 is a schematic cross-sectional view showing the structure of a spark plug according to an embodiment of the present invention. A spark plug 100 includes a metal shell 1, an insulator 2, a center electrode 3, a ground electrode 4, and a metal terminal 13. In FIG. 1, the center in the longitudinal direction of the spark plug 100 is represented as an axial line O. The ground electrode 4 side and the metal terminal 13 side along the axial line are referred to as a front side and a rear side of the spark plug 100, respectively.

The metal shell 1 is formed in a hollow cylindrical shape from a metal such as carbon steel and constitutes a housing of the spark plug 100. The insulator 2 of which the front side is housed within the metal shell 1 is comprised of a ceramic sintered body and has a through hole 6 formed so as to extend along the axial line O. A part of the metal terminal 13 is inserted and fixed in the first end portion side of the through hole 6, and the center electrode 3 is inserted and fixed in the second end portion side of the through hole 6. In addition, within the through hole 6, a resistor 15 is disposed between the metal terminal 13 and the center electrode 3. Both end portions of the resistor 15 are electrically connected to the center electrode 3 and the metal terminal 13 via a conductive glass seal layer 16 and a metal terminal-side conductive glass seal layer 17, respectively. The conductive glass seal layer 16, that is located at the front side with respect to the resistor 15, corresponds to a conductive glass seal layer in the claims.

The resistor 15 functions as an electric resistor between the metal terminal 13 and the center electrode 3, thereby suppressing occurrence of radio noise (noise) at the time of spark discharge. The resistor 15 is composed of ceramic powder, a conductive material, glass, and a binder (adhesive). In the present embodiment, the resistor 15 is produced through a production procedure described later.

The center electrode 3 has a firing end 31 formed at a front end thereof, and is disposed in the through hole 6 such that the firing end 31 is exposed. The ground electrode 4 is welded at one end thereof to the metal shell 1. In addition, the ground electrode 4 is laterally bent at the other end side thereof, and is disposed such that a distal end portion 32 thereof is opposed to the firing end 31 of the center electrode 3 across a gap.

A screw portion 5 is formed on the outer periphery of the metal shell 1 of the spark plug 100 having the above configuration. The spark plug 100 is mounted to a cylinder head of an engine or the like by using the screw portion 5.

A2. Manufacture of Spark Plug

Figure 2:
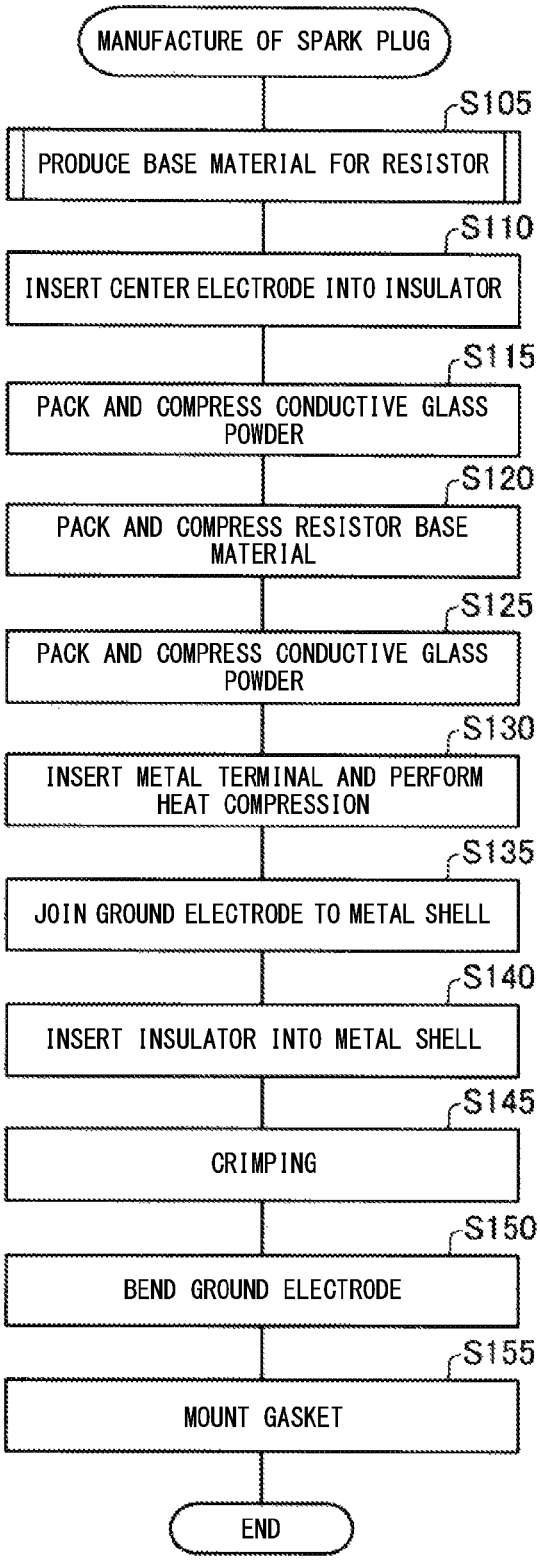
FIG. 2 is a flowchart showing a procedure of manufacturing the spark plug according to the embodiment.
Figure 3:
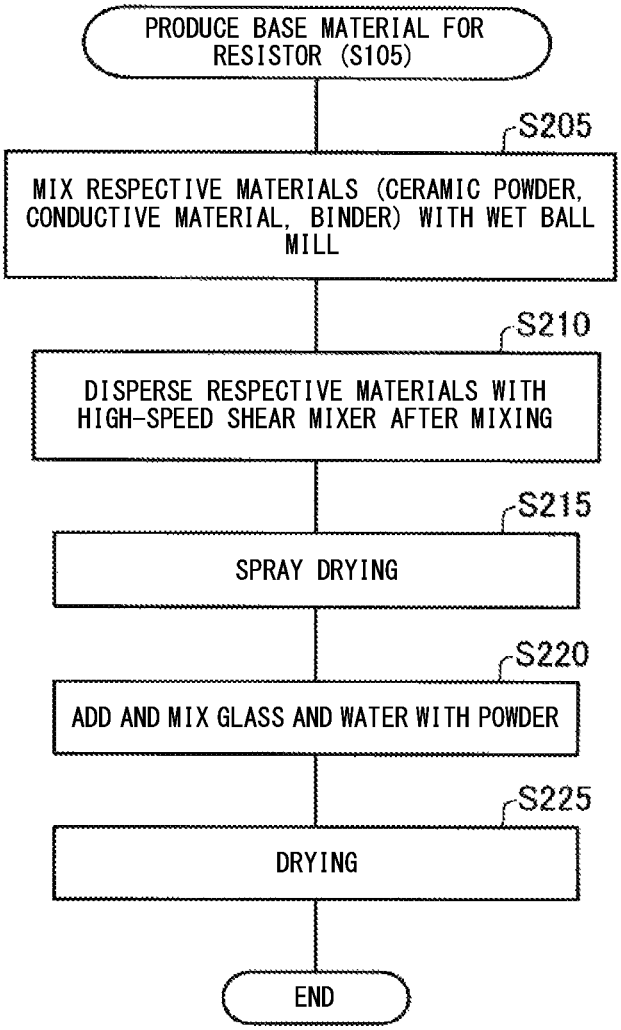
FIG. 3 is a flowchart showing a procedure of producing a base material for a resistor.

FIG. 2 is a flowchart showing a procedure of manufacturing the spark plug according to the present embodiment. FIG. 3 is a flowchart showing a procedure of producing a base material for the resistor. As shown in FIG. 2, in manufacturing the spark plug 100 according to the present embodiment, first, the base material for the resistor 15 is produced (step S105). As shown in FIG. 3, in production of the base material for the resistor 15, first, respective materials are mixed with a wet ball mill (step S205). In the present embodiment, the respective materials in step S205 mean the ceramic powder, the conductive material, and the binder. As the ceramic powder, for example, ceramic powder including $ZrO_2$ and $TiO_2$ may be used. As the conductive material, for example, carbon black may be used. As the binder (organic binder), for example, a dispersing agent such as a polycarboxylic acid may be used. Water as a solvent is added to these respective materials, and is agitated and mixed by using the wet ball mill. At this time, the respective materials are mixed, but the degrees of dispersion of the respective materials are relatively low.

Next, after the mixing, the respective materials are dispersed with a high-speed shear mixer (step S210). The high-speed shear mixer is a mixer which mixes materials while greatly dispersing the materials with a strong shearing force caused by a blade (agitating blade). As the high-speed shear mixer, for example, an axial mixer may be used. Due to the mixing with the high-speed shear mixer, the degrees of dispersion of the respective materials increase.

The material obtained by step S210 is immediately granulated by a spray drying method (step S215). Glass (coarse-grained glass powder) and water are added and mixed with the powder obtained by step S215 (step S220) and are dried (step S225), thereby completing the base material (powder) for the resistor 15. As a mixer used for the above mixing in step S220, for example, a universal mixer may be used.

After the production of the base material for the resistor 15 is completed, the center electrode 3 is inserted into the through hole 6 of the insulator 2 as shown in FIG. 2 (step S110). Conductive glass powder is packed into the through hole 6 and compressed (step S115). This compression can be achieved, for example, by inserting a bar-shaped jig into the through hole 6 and pressing the accumulated conductive glass powder in the through hole 6. A layer of the conductive glass powder formed by step S115 is made into the conductive glass seal layer 16 in FIG. 1 through a heat compression step described later. As the conductive glass powder, for example, powder obtained by mixing copper powder and calcium borosilicate glass powder may be used.

The base material (powder) for the resistor 15 produced in step S105 is packed into the through hole 6 and compressed (step S120), and conductive glass powder is further packed into the through hole 6 and compressed (step S125). A layer of the powder formed by step S120 is made into the resistor 15 shown in FIG. 1 through the heat compression step described later. Similarly, a layer of the powder formed by step S125 is made into the metal terminal-side conductive glass seal layer 17 shown in FIG. 1 through the heat compression step described later. As the conductive glass powder used in step S125, powder which is the same as the conductive glass powder used in step S115 may be used. In addition, as methods of the compression in steps S120 and S125, a method which is the same as the method of the compression in step S115 may be used.

A part of the metal terminal 13 is inserted into the through hole 6, and a predetermined pressure is applied from the metal terminal 13 side to the insulator 2 while the entire insulator 2 is heated (step S130). By the heat compression step, the respective materials packed in the through hole 6 are compressed and baked, so that the conductive glass seal layer 16, the metal terminal-side conductive glass seal layer 17, and the resistor 15 are formed within the through hole 6.

A ground electrode is joined to the metal shell 1 (step S135), the insulator 2 is inserted into the metal shell 1 (step S140), and the metal shell 1 is crimped (step S145). By the crimping step in step S145, the insulator 2 is fixed to the metal shell 1. Next, the distal end of the ground electrode joined to the metal shell 1 is bent (step S150), thereby completing the ground electrode 4 shown in FIG. 1. Thereafter, a gasket which is not shown is mounted on the metal shell 1 (step S155), thereby completing the spark plug 100.

Figure 4:
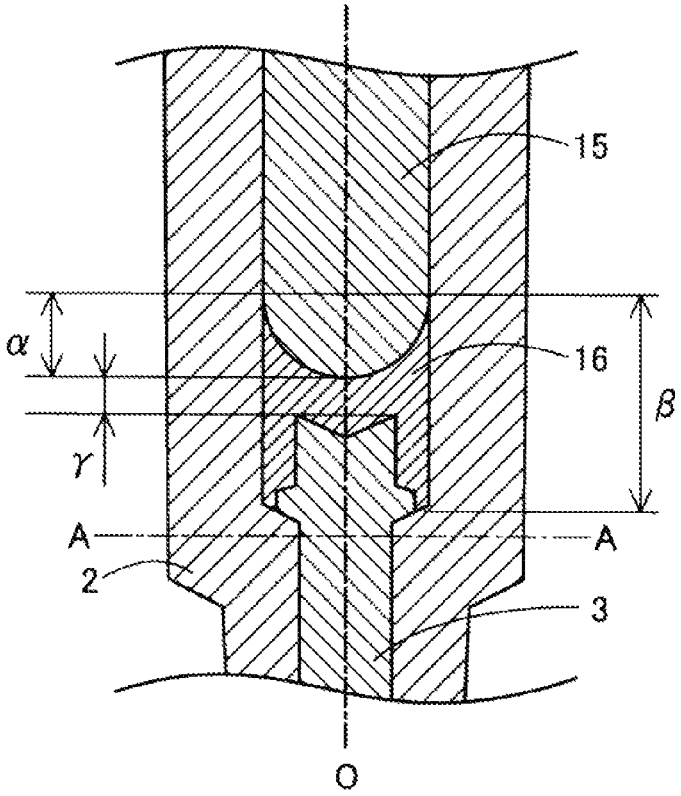
FIG. 4 is an enlarged cross-sectional view of a joined surface of a glass seal layer and the resistor.

Next, the shapes of the conductive glass seal layer 16 and the resistor 15 of the spark plug 100 produced thus will be described. The joined surface of the resistor 15 and the conductive glass seal layer 16 is formed in a convex shape toward the conductive glass seal layer 16 side, that is, the front side of the spark plug 100. FIG. 4 is an enlarged cross-sectional view showing the joined surface of the resistor 15 and the conductive glass seal layer 16. In the present embodiment, the outer diameter of each of the resistor 15 and the conductive glass seal layer 16 is denoted by R, and further the following three amounts α, β, and γ are defined.

- α: the length along the axial line O from the rear end to the front end of the joined surface of the resistor 15 and the conductive glass seal layer 16 (referred to as "rise amount" as necessary).
- β: the maximum length of the conductive glass seal layer 16 in the direction of the axial line O (referred to as "sealing material length" as necessary).
- γ: the shortest distance in the direction of the axial line O from the joined surface of the resistor 15 and the conductive glass seal layer 16 to the center electrode 3 (referred to as "inter-resistor distance" as necessary).

The amounts α, β, and γ are measured by cutting the produced spark plug 100 along a plane perpendicular to the axial line O and scraping the cross section thereof in the direction of the axial line O. In FIG. 4, when the spark plug 100 is cut at a position shown by an A-A line and then scraped from the position toward the rear side of the spark plug 100 such that a flat surface perpendicular to the axial line O is maintained, only the insulator 2 and the center electrode 3 are initially exposed in the cross section, and the conductive glass seal layer 16 is exposed later. This position becomes one end of the sealing material length β. When the spark plug 100 is scraped further, the center electrode 3 disappears from the cross section, and only the insulator 2 and the conductive glass seal layer 16 are present in the cross section. This position becomes one end of the inter-resistor distance γ. When the spark plug 100 is scraped further, the resistor 15 appears at the center of the cross section. This position is the other end of the inter-resistor distance γ and becomes one end of the rise amount α.

In this state, the insulator 2 is present at the outermost periphery of the cross section, and the conductive glass seal layer 16 is present in an annular shape at the inner side of the insulator 2, and the resistor 15 is present at the center. When the spark plug 100 is scraped further therefrom, the width of the annular conductive glass seal layer 16 gradually decreases, and a state is obtained in which the annular shape is interrupted at a certain location. The position immediately before the conductive glass seal layer 16 partially disappears even at one location as described above becomes the other ends of the rise amount α and the sealing material length β. Respective dimensions α, β, and γ in examples described later are measured by such a method. In addition, the outer diameter R of the resistor 15 and the conductive glass seal layer 16 is set at a desired dimension by adjusting the inner diameter of the through hole 6 of the insulator 2. In the following description, the outer diameter R of the resistor 15 and the conductive glass seal layer 16 is referred to as seal diameter.

B. Examples

On the basis of the embodiment described above, 15 kinds of spark plugs 100 (samples 1 to 15) each having a seal diameter R of 3.0 mm or 3.9 mm were manufactured in total. The samples 1 to 15 were produced with the above dimensions α, β, and γ made different. For these samples, the value of α/β was adjusted by changing the heating temperature in the heat compression step. The value of α/β may be adjusted by changing the pressure applied in the heat compression step.

Each manufactured spark plug 100 was evaluated for airtightness. The airtightness evaluation was performed as follows. The spark plugs 100 of the samples 1 to 15 each were mounted to a pressurization chamber of a tester which corresponds to a combustion chamber of an internal combustion engine, by using the screw portion 5, compressed air having a predetermined pressure was added into the pressurization chamber at room temperature for 1 minute, and an amount of leak from the rear side of the spark plug 100 was measured. The pressure of the compressed air was changed, the airtightness was evaluated on the basis of in which range the pressure of the compressed air with which the amount of leak from the rear end of the spark plug 100 (the rear end of the through hole 6) became equal to or less than 1.5 ml (milliliter) per minute fell, and this evaluation is represented as symbols A to F in FIG. 5. If the amount of leak was equal to or less than 1.5 ml/min even when the pressure of the compressed air was increased to 10 MPa, the airtightness was evaluated as A. Further, the airtightness was evaluated on the basis of the pressure of the compressed air with which the amount of leak became equal to or less than 1.5 ml/min, as follows:

- if the pressure was 7.5 MPa, the airtightness was evaluated as B;
- if the pressure was 5.0 MPa, the airtightness was evaluated as C;
- if the pressure was 3.0 MPa, the airtightness was evaluated as D;
- if the pressure was 2.5 MPa, the airtightness was evaluated as E; and
- if the pressure was 2.0 MPa, the airtightness was evaluated as F.

According to the airtightness evaluation results of the samples 1 to 15, even when the seal diameter R was equal to or less than 3.9 mm, if the joined surface of the conductive glass seal layer 16 and the resistor 15 had a convex shape toward the center electrode 3 side and $\alpha/\beta \geq 0.4$, the airtightness evaluation was E or higher. Hereinafter, α/β is referred to as "sealing material length ratio." If the inter-resistor distance γ was equal to or greater than 3.0 mm in addition to the condition of sealing material length ratio $\alpha/\beta \geq 0.4$, the airtightness evaluation was C. If the sealing material length β was equal to or greater than 11 mm in addition to the above conditions, the airtightness evaluation was B or higher. When the samples in which the seal diameter R and the sealing material length ratio α/β were the same values are reviewed, for example, when the samples 7, 9, and 11 (seal diameter R=3.0, sealing material length ratio α/β=0.4) or the samples 8, 10, and 12 (R=3.9, α/β=0.4) are compared, it is recognized that the airtightness evaluation tends to be higher as the inter-resistor distance γ increases. In addition, when each sample is compared, the airtightness evaluation tends to increase as the sealing material length β increases. In particular, the airtightness evaluation of each sample in which sealing material length β>11 mm was B or higher. If these three conditions (α/β≥0.4, γ≥3.0 mm, and β≥11 mm) were met, the airtightness evaluation was B or higher even when the seal diameter R was 3.0 mm.

C. Modified Embodiments

The conductive glass seal layer 16 only needs to be formed by melting a mixture including glass powder and metal powder, and copper powder and calcium borosilicate glass powder are mixed and used in the embodiment described above. However, another metal material and other glass powder may be used. In addition, powder of carbon black or graphite may be used as a conductive substance instead of metal powder.

In the embodiment described above, regarding the base material for the resistor 15, ceramic powder including $ZrO_2$ and $TiO_2$ is used as the ceramic powder, carbon black is used as the conductive material, and a dispersing agent such as a polycarboxylic acid is used as the binder (organic binder). However, other materials may be used. For example, metal powder including any one or more metals among Al, Zn, Fe, Cu, Mg, Sn, Ti, Zr, Ag, and Ga may be used as the conductive material.

The present invention is not limited to the embodiment, examples, and modified embodiments described above, and can be embodied in various configurations without departing from the gist of the present invention. For example, the technical features in the embodiment, examples, and modified embodiments corresponding to the technical features in each mode described in the Summary of the Invention section can be appropriately replaced or combined to solve some of or all of the foregoing problems, or to achieve some of or all of the foregoing effects. Further, such technical features may be appropriately deleted if not described as being essential in the present specification.

DESCRIPTION OF REFERENCE NUMERALS

1: metal shell
2: insulator
3: center electrode
4: ground electrode
5: screw portion
6: through hole
13: metal terminal
15: resistor
16: conductive glass seal layer
17: metal terminal-side conductive glass seal layer
31: firing end
32: distal end portion
100: spark plug
O: axial line Having described the invention, the following is claimed:

1. A spark plug comprising:
a tubular metal shell;
an insulator held within the metal shell and having a through hole formed therein so as to extend along a direction of an axial line of the metal shell;
a center electrode inserted and fixed in a first end portion of the through hole of the insulator;
a metal terminal inserted and fixed in a second end portion of the through hole of the insulator;
a resistor disposed within the through hole and between the center electrode and the metal terminal so as to be spaced apart from the center electrode in the direction of the axial line; and
a conductive glass seal layer provided within the through hole and between the resistor and the center electrode and electrically connecting the resistor and the center electrode to each other, wherein
the conductive glass seal layer has a diameter of 3.9 mm or less,
a joined surface of the conductive glass seal layer and the resistor has a convex shape toward the center electrode side, and
when: α represents a length in the direction of the axial line from a rear end to a front end of the joined surface; and
β represents a maximum length of the conductive glass seal layer in the direction of the axial line,
a relation of α/β≥0.4 is satisfied.

2. A spark plug according to claim 1, wherein a shortest distance γ in the direction of the axial line from the joined surface to the center electrode is equal to or greater than 3 mm.

3. A spark plug according to claim 1 or 2, wherein the maximum length β is equal to or greater than 11 mm.

4. A spark plug according to claim 1 or 2, wherein the diameter of the conductive glass seal layer is equal to or less than 3.0 mm.

5. A spark plug according to claim 1 or 2, wherein a screw portion is formed on an outer periphery of the metal shell and has a diameter of M12 or less.

6. A spark plug according to claim 3, wherein the diameter of the conductive glass seal layer is equal to or less than 3.0 mm.

7. A spark plug according to claim 3, wherein a screw portion is formed on an outer periphery of the metal shell and has a diameter of M12 or less.

8. A spark plug according to claim 4, wherein a screw portion is formed on an outer periphery of the metal shell and has a diameter of M12 or less.

* * * * *